US005614485A

United States Patent [19]

Painter

[11] Patent Number: 5,614,485

[45] Date of Patent: Mar. 25, 1997

[54] PROCESS FOR MAKING A GRANULAR DISHWASHING COMPOSITION BY AGGLOMERATING INGREDIENTS AND ADMIXING SOLID ALKALI METAL SILICATE

[75] Inventor: Jeffrey D. Painter, Cincinnati, Ohio

[73] Assignee: The Procter & Gamble Company, Cincinnati, Ohio

[21] Appl. No.: 659,991

[22] Filed: Jun. 7, 1996

Related U.S. Application Data

[63] Continuation of Ser. No. 263,165, Jun. 21, 1994, abandoned, which is a continuation of Ser. No. 110,474, Aug. 23, 1993, abandoned, which is a continuation of Ser. No. 808,965, Dec. 16, 1991, abandoned, which is a continuation of Ser. No. 550,420, Jul. 10, 1990, abandoned.

[51] Int. Cl.[6] ..... C11D 11/00

[52] U.S. Cl. ..... 510/444; 510/220; 510/224; 510/229; 510/230; 510/511

[58] Field of Search ..... 510/444, 220, 510/224, 229, 230, 511

[56] References Cited

U.S. PATENT DOCUMENTS

| | | | |
|---|---|---|---|
| 2,895,916 | 7/1959 | Milenkevich et al. | 252/99 |
| 3,112,274 | 11/1959 | Morgenthaler et al. | 252/99 |
| 3,247,118 | 4/1966 | Matthaei | 252/99 |
| 3,306,858 | 2/1967 | Oberle | 252/99 |
| 3,359,207 | 12/1967 | Kaneke et al. | 252/99 |
| 3,361,675 | 1/1968 | Fuchs et al. | 252/99 |
| 3,579,455 | 5/1971 | Sabatelli | 252/135 |
| 3,609,088 | 9/1971 | Sumner | 252/99 |
| 3,625,902 | 12/1971 | Sumner | 252/99 |
| 3,741,904 | 6/1973 | Christensen et al. | 252/99 |
| 3,888,781 | 6/1975 | Kingrey et al. | 252/99 |
| 3,933,670 | 1/1976 | Brill et al. | 252/99 |
| 3,956,467 | 5/1976 | Bertorelli | 423/332 |
| 4,141,841 | 2/1979 | McDanald | 252/8.8 |
| 4,169,806 | 10/1979 | Davis et al. | 252/99 |
| 4,207,197 | 6/1980 | Davis et al. | 252/99 |
| 4,228,025 | 10/1980 | Jacobsen | 252/99 |
| 4,379,069 | 4/1983 | Rapisanda et al. | 252/135 |
| 4,379,080 | 4/1983 | Murphy | 252/526 |
| 4,427,417 | 1/1984 | Porasik | 252/135 |
| 4,526,702 | 7/1985 | Parr | 252/174.25 |
| 4,588,515 | 5/1986 | Schuh et al. | 252/99 |
| 4,657,693 | 4/1987 | Wise et al. | 252/174.21 |
| 4,663,071 | 5/1987 | Bush et al. | 252/174.19 |
| 4,699,729 | 10/1987 | Parr | 252/174.25 |
| 4,714,562 | 12/1987 | Roselle et al. | 252/94 |
| 4,726,908 | 2/1988 | Kruse et al. | 252/91 |
| 4,731,196 | 4/1988 | Staton et al. | 252/174.24 |
| 4,828,721 | 5/1989 | Bollier et al. | 252/8.7 |
| 4,923,628 | 5/1990 | Appel et al. | 252/135 |
| 4,923,636 | 5/1990 | Blackburn et al. | 252/550 |
| 4,931,203 | 6/1990 | Ahmed et al. | 252/99 |
| 4,946,627 | 8/1990 | Leighton et al. | 252/542 |
| 4,988,454 | 1/1991 | Eertink et al. | 252/140 |

FOREIGN PATENT DOCUMENTS

| | | |
|---|---|---|
| 2006687 | 6/1990 | Canada . |
| 0330060 | 8/1989 | European Pat. Off. . |
| 0352135 | 1/1990 | European Pat. Off. . |

*Primary Examiner*—Douglas J. McGinty
*Assistant Examiner*—Lorna M. Douyon
*Attorney, Agent, or Firm*—Mary P. McMahon; Michael D. Jones; Brian M. Bolam

[57] ABSTRACT

A process for the manufacture of a high bulk density granular dishwashing detergent composition which comprises agglomerating ingredients with a liquid binder to form base granules which are substantially free of alkali metal silicates followed by admixing alkali metal silicate. The process provides uniform delivery of detergent ingredients and improved solubility.

17 Claims, No Drawings

PROCESS FOR MAKING A GRANULAR DISHWASHING COMPOSITION BY AGGLOMERATING INGREDIENTS AND ADMIXING SOLID ALKALI METAL SILICATE

This is a continuation of application Ser. No. 08/263,165, filed on Jun. 21, 1994 now abandoned, which is a continuation of application Ser. No. 08/110,474 filed Aug. 23, 1993, now abandoned, which is a continuation of Ser. No. 07/808,965, filed Dec. 16, 1991, now abandoned, which is a continuation of Ser. No. 07/550,420, filed Jul. 10, 1990, now abandoned.

TECHNICAL FIELD

The present invention relates to a process for making a high bulk density, agglomerated dishwashing detergent composition exhibiting improved solubility.

BACKGROUND OF THE INVENTION

Granular dishwashing detergent compositions and their components, e.g. builders, alkaline salts, sodium silicate, low-foaming surfactant, chlorine bleach, etc., are well known in the art. A number of processes have been described for the continuous production of such dishwashing detergent compositions.

Generally, mechanical mixing processes are less desirable because they result in segregation of ingredients in the package due to differences in the particle size, shape, and density of the detergent ingredients. It has been found that detergent compositions manufactured via a mechanical mixing process exhibit wide variation of detergent ingredients delivered by the composition to the dishwashing solution during actual use. For example, Rapisarda et al U.S. Pat. No. 4,379,069, describes a mechanical mixing process whereby a silicate free alkaline blend of detergent ingredients is prepared followed by mixing of solid alkali metal silicate.

On the other hand, detergent compositions made using agglomeration processes deliver more uniform levels of detergent ingredients during actual use due to the uniform distribution of the detergent ingredients among the individual detergent granules in the composition. See, for example, Porasik U.S. Pat. No. 4,427,417, issued Jan. 24, 1984.

Agglomeration processes for making granular dishwashing detergent compositions described in the prior art generally employ alkali metal silicates as the primary liquid binder. These silicates, as aqueous solutions, provide adhesion properties required in agglomeration processes for the detergent ingredients to form the detergent granules. Unfortunately, compositions manufactured using silicate as the liquid binder sometimes exhibit a high level of insoluble residue due to polymerization of the silicate during drying of wet agglomerates and storage of the detergent composition.

It has now been found that a significant improvement in solubility can be achieved by using a liquid binder other than alkali metal silicate solution, such as an aqueous solution of a water-soluble polymer like sodium polyacrylate. During drying of the wet agglomerates, the water-soluble polymer does not form insolubles like alkali metal silicates do. Further, granules agglomerated with a water-soluble polymer such as polyacrylate will not develop insolubles during storage like base granules agglomerated with the silicate. The alkali metal silicate can be post-added as a dry solid to the agglomerated base product.

It is an object of this invention to use an agglomeration process to produce high bulk density agglomerated dishwashing products containing admixed silicate with significantly improved solubility over agglomerated products made using silicate as the liquid binder.

It is another object of this invention to utilize a liquid binder other than silicate, such as an aqueous solution of a water-soluble polymer like sodium polyacrylate to agglomerate detergent ingredients into granular particles with uniform composition.

Other objects and advantages will be apparent from the following description and examples.

SUMMARY OF THE INVENTION

The present invention encompasses processes for making granular dishwashing detergents exhibiting improved solubility comprising:

(a) agglomerating from about 5% to about 95% detergency builder material with from about 3% to about 30% of a liquid binder to form base detergent granules being substantially free of alkali metal silicates; and (b) admixing with the granules formed in step (a) a solid alkali metal silicate and a bleach ingredient to form the granular dishwashing detergent composition, said composition comprising, by weight, from about 10% to about 80% detergency builder material, an amount of silicate sufficient to provide from about 4% to about 20% $SiO_2$, and an amount of bleach ingredient sufficient to provide 0% to about 5% available chlorine or available oxygen;

wherein the bulk density of the composition is from about 0.7 to about 1.2.

The liquid binder used in the agglomeration step (a) is an aqueous solution of a water-soluble polymer preferably selected from the group consisting of alkali metal salts of polycarboxylic acids especially polyacrylates with an average molecular weight in acid form of from about 1,000 to about 10,000, and acrylate/maleate or acrylate/fumarate copolymers with an average molecular weight in acid form of from about 2,000 to about 80,000 and a ratio of acrylate to maleate or fumarate segments of from about 30:1 to about 2:1, and mixtures thereof.

DETAILED DESCRIPTION OF THE INVENTION

The granular detergent composition of the invention comprises of a base detergent granule formed by agglomerating a detergency builder material with a liquid binder followed by admixing a solid alkali metal silicate and bleach ingredient. The component materials are described in detail below.

LIQUID BINDER

The base detergent granules are formed using a liquid binder. The liquid binder can be employed in forming the base detergent granules in an amount from about 3% to about 30%, preferably from about 4% to about 25%, most preferably from about 5% to about 20%, by weight.

The liquid binder can be an aqueous solution of a water-soluble polymer. This solution can comprise from about 10% to about 70%, preferably from about 20% to about 60%, and most preferably from about 30% to about 50%, by weight of the water-soluble polymer.

Solutions of the film-forming polymers described in Murphy U.S. Pat. No. 4,379,080, issued Apr. 5, 1983, incorporated herein by reference, can be used as the liquid binder.

Suitable polymers for use in the aqueous solutions are at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 2000 to about 250,000, and most preferably is from about 3000 to about 100,000.

Other suitable polymers include those disclosed in Diehl U.S. Pat. No. 3,308,067 issued Mar. 7, 1967, incorporated herein by reference. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable provided that such segments do not constitute more than about 40% by weight of the polymer.

Other suitable polymers for use herein are copolymers of acrylamide and acrylate having a molecular weight of from about 3,000 to about 100,000, preferably from about 4,000 to about 20,000, and an acrylamide content of less than about 50%, preferably less than about 20%, by weight of the polymer. Most preferably, the polymer has a molecular weight of from about 4,000 to about 10,000 and an acrylamide content of from about 0% to about 15%, by weight of the polymer.

Particularly preferred liquid binders are aqueous solutions of polyacrylates with an average molecular weight in acid form of from about 1,000 to about 10,000, and acryl ate/maleate or acrylate/fumarate copolymers with an average molecular weight in acid form of from about 2,000 to about 80,000 and a ratio of acrylate to maleate or fumarate segments of from about 30:1 to about 2:1. This and other suitable copolymers based on a mixture of unsaturated mono- and dicarboxylate monomers are disclosed in European Patent Application No. 66,915, published Dec. 15, 1982, incorporated herein by reference.

Other polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol.

The polyethylene, polypropylene and mixed glycols are conveniently referred to by means of the structural formula $$HO-(CH_2-CH_2O)_m-(CH_2-\overset{\overset{CH_3}{|}}{C}HO)_n-(\overset{\overset{CH_3}{|}}{C}H-CH_2O)_o-H$$

wherein m, n, and o are integers satisfying the molecular weight and temperature requirements given above.

Other polymers useful herein include the cellulose sulfate esters such as cellulose acetate sulfate, cellulose sulfate, hydroxyethyl cellulose sulfate, methyl cellulose sulfate, and hydroxypropylcellulose sulfate. Sodium cellulose sulfate is the most preferred polymer of this group.

Other suitable polymers are the carboxylated polysaccharides, particularly starches, celluloses and alginates, described in Diehl U.S. Pat. No. 3,723,322, issued Mar. 27, 1973; the dextrin esters of polycarboxylic acids disclosed in Thompson U.S. Pat. No. 3,919,107, issued Nov. 11, 1975; the hydroxyalkyl starch ethers, starch esters, oxidized starches, dextrins and starch hydrolysates described in Jensen U.S. Pat. No. 3,803,285, issued Apr. 9, 1974; and the carboxylated starches described in Eldib U.S. Pat. No. 3,629,121, issued Dec. 21, 1971; and the dextrin starches described in McDanald U.S. Pat. No. 4,141,841, issued Feb. 27, 1979; all incorporated herein by reference. Preferred polymers of the above group are the carboxymethyl celluloses.

The low-foaming nonionic surfactants described hereinafter can be used as the liquid binder, provided they are in the liquid form or are premixed with another liquid binder. These surfactants are particularly preferred when used in conjunction with the polymers described hereinbefore.

In general, the liquid binder can comprise any one or a mixture of the binders described above.

DETERGENCY BUILDER MATERIAL

The detergency builder material used to form the base detergent granules can be any of the detergent builder materials known in the art which include the various water-soluble, alkali metal, ammonium or substituted ammonium phosphates, polyphosphates, phosphonates, polyphosphonates, carbonates, borates, polyhydroxysulfonates, polyacetates, carboxylates, and polycarboxylates. Preferred are the alkali metal, especially sodium, salts of the above and mixtures thereof.

The amount of builder material used to form the base detergent granule is from about 5% to about 95%, preferably from about 15% to about 85%, by weight.

The builder material is present in the detergent composition in an amount from about 10% to about 80%, most preferably from about 15% to about 65%, by weight of the composition.

Specific examples of inorganic phosphate builders are sodium and potassium tripolyphosphate, pyrophoshate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137, 3,400,176 and 3,400,148, incorporated herein by reference.

Examples of non-phosphorus, inorganic builders are sodium and potassium carbonate, bicarbonate, sesquicarbonate and hydroxide.

Water-soluble, non-phosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylene diamine tetraacetic acid, nitrilotriacetic acid, tartrate monosuccinic acid, tartrate disuccinic acid, oxydisuccinic acid, carboxy methyloxysuccinic acid, mellitic acid, benzene polycarboxylic acids, and citric acid.

Preferred detergency builder materials have the ability to remove metal ions other than alkali metal ions from washing solutions by sequestration, which as defined herein includes chelation, or by precipitation reactions. Sodium tripolyphosphate is a particularly preferred detergency builder material which is a sequestering agent. Sodium citrate is also a particularly preferred detergency builder, particularly when it is desirable to reduce the total phosphorus level of the compositions of the invention.

Particularly preferred compositions of the invention contain from about 15% to about 35% sodium tripolyphosphate and from about 10% to about 35% sodium carbonate, by weight of the composition. When it is desirable to reduce the total phosphorous level of the composition, sodium citrate levels from about 2% to about 30% by weight of the composition are particularly preferred as a replacement for the phosphate builder material.

LOW-FOAMING SURFACTANT

The compositions of the invention can additionally contain a low-foaming, bleach-stable surfactant. The surfactant can be present in the composition in an amount from about 0.1% to about 8%, preferably from about 0.5% to about 5%, by weight of the composition.

The surfactant can be incorporated into the composition herein by first loading the surfactant onto the builder material. Under those conditions the surfactant is used in an amount from about 0.1% to about 16%, by weight.

Suitable surfactants include nonionic surfactants, especially those which are solid at 35° C. (95° F.), more preferably those which are solid at 25° C. (77° F.). Reduced surfactant mobility is a consideration in stability of the bleach component. Preferred surfactant compositions with relatively low solubility can be incorporated in compositions containing alkali metal dichlorocyanurates or other organic chlorine bleaches without an interaction that results in loss of available chlorine. The nature of this problem is disclosed in Rapisarda et al U.S. Pat. No. 4,309,299 issued Jan. 5, 1982 and Kaneko et al in U.S. Pat. No. 3,359,207, issued Dec. 19, 1967, both patents being incorporated herein by reference.

In a preferred embodiment the surfactant is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkylphenol on an average basis.

A particularly preferred ethoxylated nonionic surfactant is derived from a straight chain fatty alcohol containing from about 16 to about 20 carbon atoms ($C_{16-20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The ethoxylated nonionic surfactant can optionally contain propylene oxide in an amount up to about 15% by weight of the surfactant and retain the advantages hereinafter described. Preferred surfactants of the invention can be prepared by the processes described in Guilloty U.S. Pat. No. 4,223,163, issued Sep. 16, 1980, incorporated herein by reference.

The most preferred composition contains the ethoxylated monohydroxyalcohol or alkyl phenol and additionally comprises a polyoxyethylene, polyoxypropylene block polymeric compound; the ethoxylated monohydroxy alcohol or alkyl phenol nonionic surfactant comprising from about 20% to about 80%, preferably from about 30% to about 70%, of the total surfactant composition by weight.

Suitable block polyoxyethylene-polyoxypropylene polymeric compounds that meet the requirements described hereinbefore include those based on ethylene glycol, propylene glycol, glycerol, trimethylolpropane and ethylenediamine as the initiator reactive hydrogen compound. Polymeric compounds made from a sequential ethoxylation and propoxylation of initiator compounds with a single reactive hydrogen atom, such as $C_{12-18}$ aliphatic alcohols, do not provide satisfactory suds control in the detergent compositions of the invention. Certain of the block polymer surfactant compounds designated PLURONIC and TETRONIC by the BASF-Wyandotte Corp., Wyandotte, Mich., are suitable in the surfactant compositions of the invention.

Because of the relatively high polyoxypropylene content, e.g., up to about 90% of the block polyoxyethylene-polyoxypropylene polymeric compounds of the invention and particularly when the polyoxypropylene chains are in the terminal position, the compounds are suitable for use in the surfactant compositions of the invention and have relatively low cloud points. Cloud points of 1% solutions in water are typically below about 32° C. and preferably from about 15° C. to about 30° C. for optimum control of sudsing throughout a full range of water temperatures and water hardnesses.

Anionic surfactants including alkyl sulfonates and sulfates containing from about 8 to about 20 carbon atoms; alkylbenzene sulfonates containing from about 6 to about 13 carbon atoms in the alkyl group, and the preferred low-sudsing mono- and/or dialkyl phenyl oxide mono- and/or di-sulfonates wherein the alkyl groups contain from about 6 to about 16 carbon atoms are also useful in the present invention. All of these anionic surfactants are used as stable salts, preferably sodium and/or potassium.

Other bleach-stable surfactants include trialkyl amine oxides, betaines, etc. such surfactants are usually high sudsing. A disclosure of bleach-stable surfactants can be found in published British Patent Application No. 2,116,199A; Hartman U.S. Pat. No. 4,005,027; Rupe et al U.S. Pat. No. 4,116,851; and Leikhim U.S. Pat. No. 4,116,849, all of which are incorporated herein by reference.

The preferred surfactants of the invention in combination with the other components of the composition provide excellent cleaning and outstanding performance from the standpoints of residual spotting and filming. In these respects, the preferred surfactants of the invention provide generally superior performance relative to ethoxylated nonionic surfactants with hydrophobic groups other than monohydroxy alcohols and alkylphenols, for example, polypropylene oxide or polypropylene oxide in combination with diols, triols and other polyglycols or diamines.

ALKALI-METAL SILICATE

The compositions of the type described herein deliver their bleach and alkalinity to the wash water very quickly. Accordingly, they can be aggressive to metals, dishware, and other materials, which can result in either discoloration by etching, chemical reaction, etc. or weight loss. The alkali metal silicate hereinafter described provide protection against corrosion of metals and against attack on dishware, including fine china and glassware.

The $SiO_2$ level should be from about 4% to about 20%, preferably from about 5% to about 15%, more preferably from about 6% to about 12%, based on the weight of the composition. The ratio of $SiO_2$ to the alkali metal oxide ($M_2O$, where M=alkali metal) is typically from about 1 to about 3.2, preferably from about 1.6 to about 3, more preferably from about 2 to about 2.4.

The highly alkaline metasilicate can be employed, although the less alkaline hydrous alkali metal silicates having a $SiO_2$:$M_2O$ ratio of from about 2.0 to about 2.4 are preferred. Anhydrous forms of the alkali metal silicates with a $SiO_2$:$M_2O$ ratio of 2.0 or more are less preferred because they tend to be less soluble than the hydrous alkali metal silicates having the same ratio.

Sodium and potassium, and especially sodium silicates are preferred. A particularly preferred alkali metal silicate is a granular hydrous sodium silicate having a $SiO_2$:$Na_2O$ ratio of from 2.0 to 2.4 available from PQ Corporation, namely Britesil H20 and Britesil H24.

BLEACH INGREDIENT

The compositions of the invention can contain an amount of a bleach ingredient sufficient to provide the composition with from 0% to about 5%, preferably from about 0.1%, to about 5.0%, most preferably from about 0.5% to about 3.0%, of available chlorine or available oxygen based on the weight of the detergent composition.

An inorganic chlorine bleach ingredient such as chlorinated trisodium phosphate can be utilized, but organic chlorine bleaches such as the chlorocyanurates are preferred. Water-soluble dichlorocyanurates such as sodium or potassium dichloroisocyanurate dihydrate are particularly preferred.

Methods of determining "available chlorine" of compositions incorporating chlorine bleach materials such as hypochlorites and chlorocyanurates are well known in the art. Available chlorine is the chlorine which can be liberated by acidification of a solution of hypochlorite ions (or a material that can form hypochlorite ions in solution) and at least a molar equivalent amount of chloride ions. A conventional analytical method of determining available chlorine is addition of an excess of an iodide salt and titration of the liberated free iodine with a reducing agent.

The detergent compositions manufactured according to the present invention can contain bleach components other than the chlorine type. For example, oxygen-type bleaches described in Chung et al U.S. Pat. No. 4,412,934, issued Nov. 1, 1983, and peroxyacid bleaches described in European Patent Application 033,2259, Sagel et al, published Sep. 13, 1989, both incorporated herein be reference, can be used as a partial or complete replacement of the chlorine bleach ingredient described hereinbefore.

OPTIONAL INGREDIENTS

The automatic dishwashing compositions of the invention can optionally contain up to about 50%, preferably from about 2% to about 20%, based on the weight of the low-foaming surfactant of an alkyl phosphate ester suds suppressor.

Suitable alkyl phosphate esters are disclosed in Schmolka et al U.S. Pat. No. 3,314,891, issued Apr. 18, 1967, incorporated herein by reference.

The preferred alkyl phosphate esters contain from 16–20 carbon atoms. Highly preferred alkyl phosphate esters are monostearyl acid phosphate and monooleyl acid phosphate, or salts thereof, particularly alkali metal salts, or mixtures thereof.

The alkyl phosphate esters of the invention have been used to reduce the sudsing of detergent compositions suitable for use in automatic dishwashing machines. The esters are particularly effective for reducing the sudsing of compositions comprising nonionic surfactants which are heteric ethoxylated-propoxylated or block polymers of ethylene oxide and propylene oxide.

Filler materials can also be present including sucrose, sucrose esters, sodium chloride, sodium sulfate, potassium chloride, potassium sulfate, etc., in amounts up to about 60%, preferably from about 5% to about 30%.

Hydrotrope materials such as sodium benzene sulfonate, sodium toluene sulfonate, sodium cumene sulfonate, etc., can be present in minor amounts.

Bleach-stable perfumes (stable as to odor); bleach-stable dyes (such as those disclosed in Roselle et al U.S. Pat. No. 4,714,562, issued Dec. 22, 1987); bleach-stable enzymes and crystal modifiers and the like can also be added to the present compositions in minor amounts.

THE PROCESS

The first step of the process of this invention can be carried out in any conventional agglomeration equipment which facilitates mixing and intimate contacting of the liquid binder with dry detergent ingredients such that it results in agglomerated granules comprising a detergency builder material and the liquid binder. Suitable mixing devices include vertical agglomerators (e.g. Schugi Flexomix or Bepex Turboflex agglomerators), rotating drums, inclined pan agglomerators, O'Brien mixers, and any other device with suitable means of agitation and liquid spray-on. Methods of agitating, mixing, and agglomerating particulate components are well-known to those skilled in the art. The apparatus may be designed or adapted for either continuous or batch operation as long as the essential process steps can be achieved.

Once agglomerated, the base granule preferably goes through a conditioning step before admixing the solid alkali metal silicate and bleaching agent. Conditioning is defined herein as that processing necessary to allow the base granule to come to equilibrium with respect to temperature and moisture content. This could involve drying off excess water introduced with the liquid binder suitable drying equipment including fluidized beds, rotary drums, etc. The free moisture content of base granule should be less than about 6%, preferably less than about 3%. As used herein, free-moisture content is determined by placing 5 grams of a sample of base detergent granules in a petri dish, placing the sample in a convection oven at 50° C. (122° F.) for 2 hours, followed by measurement of the weight loss due to water evaporation. If the liquid binder does not introduce an excess of water, conditioning may involve merely allowing time to reach equilibrium before admixing the silicate.

In cases where the compositions contain hydratable salts, it is preferable to hydrate them prior to the agglomeration step using the hydration process described in, e.g. Porasik U.S. Pat. No. 4,427,417 issued Jan. 24, 1984, incorporated herein by reference.

After conditioning, the solid alkali metal silicate and bleaching agent are admixed to the base granules using any suitable batch or continuous mixing process, so long as a homogeneous mixture results therefrom.

Optional process steps include screening and/or premixing of dry detergent ingredients before agglomeration, pre-hydration of hydratable salts, and screening and/or grinding of the base granule or final product to any desired particle size.

The bulk density of the composition after all process steps have been performed is from about 0.7 to about 1.2, preferably from about 0.8 to about 1.1 grams/cc.

As used herein, all percentages, parts, and ratios are by weight unless otherwise stated.

The following nonlimiting Examples illustrate the process of the invention and facilitate its understanding.

EXAMPLE 1

The dishwashing detergent composition set forth in Table 2 is prepared according to two different agglomeration methods described below. The liquid binder, detergency builder material, and other ingredients used to form the base detergent granules are set forth in Table 1.

TABLE 1

| | Wt. % | |
|---|---|---|
| | Method A | Method B |
| Sodium tripolyphosphate | 31.2 | 35.4 |
| Sodium carbonate | 27.4 | 31.1 |
| Nonionic surfactant/suds suppressor (1) | 2.5 | 2.8 |
| Aqueous sodium polyacrylate (2) | — | 9.5 |
| Solid sodium polyacrylate (3) | 3.8 | — |
| Aqueous sodium silicate (4) | 17.9 | — |
| Sodium sulfate, perfume, dye, & water | To 100 | To 100 |
| (Total water) | (18.8) | (16.1) |

(1) Blend of ethoxylated monohydroxy alcohol and polyoxyethylene/polyoxypropylene block polymer.
(2) A 45% aqueous solution of 4500 molecular weight sodium polyacrylate.
(3) 4500 Molecular weight sodium polyacrylate as a dry solid.
(4) A 45% solids aqueous solution of sodium silicate with an $SiO_2$:$Na_2O$ ratio of 2.4:1.

TABLE 2

| Component | Wt. % |
|---|---|
| Sodium tripolyphosphate | 33.0 (18.9% $P_2O_5$) |
| Sodium carbonate | 29.0 |
| Nonionic surfactant (1) | 2.5 |
| Suds suppressor (2) | 0.1 |
| Sodium polyacrylate (4500 molecular wt.) | 4.0 |
| Sodium silicate (2.4 ratio $SiO_2$:$Na_2O$) | 8.5 (6.0% $SiO_2$) |
| Chlorine bleach solids (3) | 1.9 |
| Sodium sulfate, perfume, dye, and water | To 100 |

(1) Blend of ethoxylated monohydroxy alcohol and polyoxyethylene/polyoxypropylene block polymer.
(2) Monostearyl acid phosphate.
(3) Sodium dichloroisocyanurate dihydrate.

Method A—Dry components comprising sodium tripolyphosphate hexahydrate containing a low-foaming nonionic surfactant (blend of ethoxylated monohydroxy alcohol and polyoxyethylene/polyoxypropylene block polymer, including 3.2% monostearyl acid phosphate for suds suppression), sodium carbonate, sodium sulfate, and sodium polyacrylate as a solid, are agglomerated with aqueous sodium silicate to form base granules which are then dried in a fluidized bed to a moisture content of 13.2% (less than 6% free moisture).

Method B—This method differs from Method A in that a water-soluble polymer, in this case an aqueous solution containing 45% sodium polyacrylate, is used in place of the aqueous sodium silicate as the liquid binder. Dry components comprising sodium tripolyphosphate hexahydrate containing a low-foaming nonionic surfactant (blend of ethoxylated monohydroxy alcohol and polyoxyethylene/polyoxypropylene block polymer, including 3.2% monostearyl acid phosphate for suds suppression), sodium carbonate, and sodium sulfate, are agglomerated with the aqueous solution of sodium polyacrylate to form base granules which are then dried in a fluidized bed to a moisture content of 13.5%. To these dried base granules solid sodium silicate is mechanically mixed to yield a homogeneous mixture.

Under both methods, minor ingredients (perfume, dye, and water) are mixed in with the liquid binder. Furthermore, once the base granules have been dried, they are put through sieves and grinders to obtain the desired particle size and cut. After sizing a chlorine bleach ingredient, i.e. sodium dichloroisocyanurate dihydrate, is mixed into the dried base granules.

The compositions prepared according to Methods A and B are evaluated for solubility using a standard $CO_2$ chamber aging procedure which evaluates the relative resistance of products to insolubles formation during storage. The results obtained from this method have been demonstrated to correlate well with actual aged solubility results obtained from storage testing.

Multiple ten gram samples of both products are placed in Petri dishes in a $CO_2$ chamber with a $CO_2$ level of 15%. Duplicate samples of each product are removed after 1, 2, 4 and 6 hours in the $CO_2$ chamber. The solubility of the samples are evaluated using the Jumbo Black Fabric Deposition Test (JBFDT) which is commonly used to evaluate the solubility of detergent products. The grading scale for the JBFDT test is a visual scale with 10 being completely soluble and 3 being completely insoluble.

Results for the samples prepared are shown in Table 2.

TABLE 3

| | Solubility Grade | |
|---|---|---|
| | Method A | Method B |
| Fresh Sample (t = 0) | 10.0 | 10.0 |
| 1 hour in $CO_2$ Chamber | 9.5 | 9.5 |
| 2 hours in $CO_2$ Chamber | 8.5 | 9.5 |
| 4 hours in $CO_2$ Chamber | 6.5 | 9.5 |
| 6 hours in $CO_2$ Chamber | 6.0 | 8.5 |

The sample agglomerated with the sodium silicate solution according to Method A loses solubility with time in the $CO_2$ chamber. The same composition agglomerated with the sodium polyacrylate solution (Method B) loses very little solubility with time. Since the bulk of the product prepared by Method B does not contain sodium silicate the total level of insoluble matter resulting from $CO_2$ exposure is much lower than the product where the base granules contain sodium silicate.

EXAMPLE 2

The dishwashing detergent composition set forth in Table 5 is prepared using two different agglomeration methods described in Example 1, with minor deviations as described below. The liquid binder, detergency builder material, and other ingredients used to form the base detergent granules are set forth in Table 4.

TABLE 4

| | Wt. % | |
|---|---|---|
| | Method A | Method B |
| Sodium citrate | 14.6 | 16.3 |
| Sodium carbonate | 14.6 | 16.3 |
| Nonionic surfactant/suds suppressor (1) | 2.5 | 2.8 |
| Aqueous sodium polyacrylate (2) | — | 9.7 |
| Solid sodium polyacrylate (3) | 3.9 | — |
| Aqueous sodium silicate (4) | 14.4 | — |
| Sodium sulfate, perfume, dye, & water | To 100 | To 100 |
| (Total water) | (10.1) | (8.7) |

(1) Blend of ethoxylated monohydroxy alcohol and polyoxyethylene/polyoxypropylene block polymer.
(2) A 44% aqueous solution of 4500 molecular weight sodium polyacrylate.
(3) 4500 Molecular weight sodium polyacrylate as a dry solid.
(4) A 44% solids aqueous solution of sodium silicate with an $SiO_2$:$Na_2O$ ratio of 2.0:1.

TABLE 5

| Component | Wt. % |
|---|---|
| Sodium citrate | 15.0 |
| Sodium carbonate | 15.0 |
| Nonionic surfactant (1) | 2.5 |
| Suds suppressor (2) | 0.1 |
| Sodium polyacrylate | 4.0 |
| Sodium silicate solids ($SiO_2$:$Na_2O$, 2.0 ratio) | 6.6 |
| Chlorine bleach solids (3) | 1.9 |
| Sodium sulfate, perfume, dye, and water | To 100 |

(1) Blend of ethoxylated monohydroxy alcohol and polyoxyethylene/polyoxypropylene block polymer. Includes 3.2% monstearyl acid phosphate for suds suppression.
(2) Monostearyl acid phosphate.
(3) Sodium dichloroisocyanurate dihydrate.

In this experiment, the low-foaming nonionic surfactant, in conjunction with the liquid binders described in Example 1, is used as a liquid binder to agglomerate the base granules. As in Example 1, both products are dried, e.g. in a fluidized bed dryer to a moisture content of 4.4% for Method A and to a moisture content of 4.1% for Method B (both less than 6% free moisture).

The two compositions are evaluated for solubility using the rapid aging method described in Example 1. Results are shown in Table 6.

TABLE 6

| | Solubility Grade | |
|---|---|---|
| | Method A | Method B |
| Fresh sample | 9.5 | 10.0 |
| 1 hour in $CO_2$ chamber | 9.0 | 9.5 |
| 2 hours in $CO_2$ chamber | 6.0 | 9.5 |
| 4 hours in $CO_2$ chamber | 5.0 | 9.0 |
| 6 hours in $CO_2$ chamber | 4.0 | 7.5 |

Again, the sample agglomerated with the sodium silicate solution according to Method A loses solubility with time in the $CO_2$ chamber. The same composition agglomerated with the sodium polyacrylate solution (Method B) loses very little solubility with time. Since the bulk of the product made according to Method B does not contain sodium silicate, the total level of insoluble matter resulting from $CO_2$ exposure is much lower than the product made by Method A where the base granules contain sodium silicate.

Other processes of the present invention are obtained when the sodium polyacrylate in the above examples is replaced with a sodium salt of an acrylate/maleate having an average molecular weight of 70,000 and a 70/30 ratio of acrylate to maleate segments.

What is claimed is:

1. A process for making a granular automatic dishwashing detergent composition comprising:

a) agglomerating, by weight of base detergent granules, from about 5% to about 95% detergency builder material with from about 3% to about 30% of a water soluble polymer liquid binder to form base detergent granules being substantially free of alkali metal silicates and having a free moisture content less than about 6%; and b) admixing with the granules formed in step (a), a solid alkali metal silicate and a bleach ingredient to form the granular automatic dishwashing detergent composition, the composition comprising by weight from about 10% to about 80% detergency builder material, an amount of silicate sufficient to provide from about 5% to about 15% $SiO_2$, and an amount of bleach ingredient sufficient to provide 0% to about 5% available chlorine or available oxygen; wherein the bulk density of the composition is from about 0.8 to about 1.1 grams/cc.

2. The process of claim 1 wherein the detergency builder material is selected from the group consisting of sodium tripolyphosphate, sodium carbonate, sodium citrate, hydrates thereof, and mixtures thereof.

3. The process of claim 1 wherein from about 15% to about 85% of detergency builder material is used to form the base granules.

4. The process of claim 2 wherein from about 15% to about 85% of detergency builder material is used to form the base granules.

5. The process of claim 1 wherein the liquid binder is an aqueous solution of alkali metal salts of polycarboxylic acids.

6. The process of claim 5 wherein the liquid binder is selected from the group consisting of aqueous solutions of alkali metal salts of polyacrylates with an average molecular weight in acid form of from about 1,000 to about 10,000, and acrylate/maleate or acrylate/fumarate copolymers with an average molecular weight in acid form of from about 2,000 to about 80,000 and a ratio of acrylate to maleate or fumarate segments of from about 30:1 to about 2:1, and mixtures thereof.

7. The process of claim 1 wherein from about 5% to about 20% of the liquid binder is used to form the base granules.

8. The process of claim 6 wherein from about 5% to about 20% of the liquid binder is used to form the base granules.

9. The process of claim 1 wherein the solid alkali metal silicate admixed in step (b) is selected from the group consisting of alkali metal silicates having a ratio of $SiO_2$:$M_2O$ of from about 1:1 to about 3.2:1, wherein M is K or Na, and mixtures thereof.

10. The process of claim 9 wherein the solid alkali metal silicate admixed in step (b) is selected from the group consisting of alkali metal silicates having a ratio of $SiO_2$:$M_2O$ of from about 2.0:1 to about 2.4:1, wherein M is K or Na, and mixtures thereof.

11. The process of claim 1 wherein the composition comprises an amount of silicate sufficient to provide from about 6% to about 12% $SiO_2$.

12. The process of claim 10 wherein the composition comprises an amount of silicate sufficient to provide from about 6% to about 12% $SiO_2$.

13. The process of claim 1 wherein from about 0.1% to about 16% of a low-foaming surfactant is loaded onto the builder material prior to agglomerating with liquid binder.

14. The process of claim 13 wherein the low-foaming surfactant comprises a low foaming, bleach stable nonionic surfactant.

15. The process of claim 1 wherein the low-foaming nonionic surfactant is solid at 35° C.

16. The process of claim 15 wherein the low-foaming nonionic surfactant is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkylphenol on an average basis.

17. The process of claim 1 wherein the moisture content of the base granule formed in step (a) is less than about 3%.

* * * * *